US006106069A

United States Patent [19]

Bock

[11] Patent Number: 6,106,069

[45] Date of Patent: Aug. 22, 2000

[54] UNIVERSAL SEAT CARRIER PANEL FOR OFFICE CHAIRS

[75] Inventor: Hermann Bock, Pyrbaum, Germany

[73] Assignee: Bock-1 GmbH & Co., Postbauer-Heng, Germany

[21] Appl. No.: 09/153,157

[22] Filed: Sep. 15, 1998

[51] Int. Cl.[7] ..... A47C 7/54

[52] U.S. Cl. ..... 297/411.35; 297/411.2

[58] Field of Search ..... 297/411.2, 411.35, 297/411.37, 463.1, 411.45, 411.26, 411.27, 411.24, 411.23

[56] References Cited

U.S. PATENT DOCUMENTS 1,488,024 3/1924 Nichols .
2,446,185 8/1948 Masucci et al. .
4,915,447 4/1990 Shovar .
5,281,001 1/1994 Bergsten et al. .
5,407,249 4/1995 Bonutti .
5,439,268 8/1995 Dozsa-Farkas .
5,462,338 10/1995 Baumann .
5,590,934 1/1997 Gibbs .
5,615,926 4/1997 Kanai et al. .
5,660,442 8/1997 Tornero .

*Primary Examiner*—Milton Nelson, Jr.
*Attorney, Agent, or Firm*—Browdy and Neimark, P.L.L.C.

[57] ABSTRACT

A universal seat carrier panel for office chairs is provided with a panel member for arrangement of a chair column, a seat carrier or the like and with a slideway integrated in the panel member for adjustability of an arm-rest holder in the horizontal longitudinal direction with respect to the office chair.

8 Claims, 4 Drawing Sheets

UNIVERSAL SEAT CARRIER PANEL FOR OFFICE CHAIRS

BACKGROUND OF THE INVENTION

1. Field of the Invention

The invention relates to a universal seat carrier panel for office chairs.

2. Background Art

Regulations on safety at work are placing higher demands on the adjustability of office chairs and parts thereof such as seat surfaces and armrests, to allow optimum adaptation of the respective chair to various physical dimensions of users and the various types of work to be performed. To achieve these variable adjustment facilities, office chairs are provided with corresponding mechanisms in the region of the seat carrier or the panel forming the seat surface. These mechanisms make the chair very complex in design, a particular problem being that it is not generally possible to omit functions for simpler office chairs. Office chairs which are more simple in construction have to be produced with correspondingly designed chair columns, seat carriers and seat surface elements.

SUMMARY OF THE INVENTION

On the basis of these problems, the object of the invention is to provide a component for office chairs in which adjustment facilities such as adjustability of the armrest holder, in particular, are integrated in a constructionally simple manner, but in which the respective adjustment function can actually be shifted or even omitted, depending on the demands placed on the office chair.

This object is achieved by a universal seat carrier panel for office chairs, which is provided with a panel member for arrangement on a chair column, a seat carrier or the like and with a slideway integrated in the panel member for the adjustability of an armrest holder in a horizontal longitudinal direction with respect to the office chair. The armrests can therefore be displaced on the chair, in the longitudinal direction thereof, as an entire unit (for example armrest holder and armrest mounted on the slideway with substantially vertically extending armrest column and horizontally extending arm support). If an adjustable armrest is not desired, the armrest holder can remain in a specific position in the slideway. The entire armrest module can also be completely omitted in a correspondingly simple office chair, the slideway on the universal seat carrier panel remaining inoperative.

Preferred embodiments of the universal seat carrier panel relate to developments of the slideway and the mounting of the armrest holder on this slideway. Further details can be inferred from the description of the various embodiments.

Further preferred embodiments of the universal seat carrier panel according to the invention relate to seat depth adjustment which is permitted in a constructionally particularly simple manner by this universal seat carrier panel. To avoid repetition, reference is made to the description of the corresponding embodiment.

The above-mentioned description relates to the accompanying drawings which show two embodiments of the subject of the invention.

DESCRIPTION OF THE PREFERRED EMBODIMENTS

Figure 1:
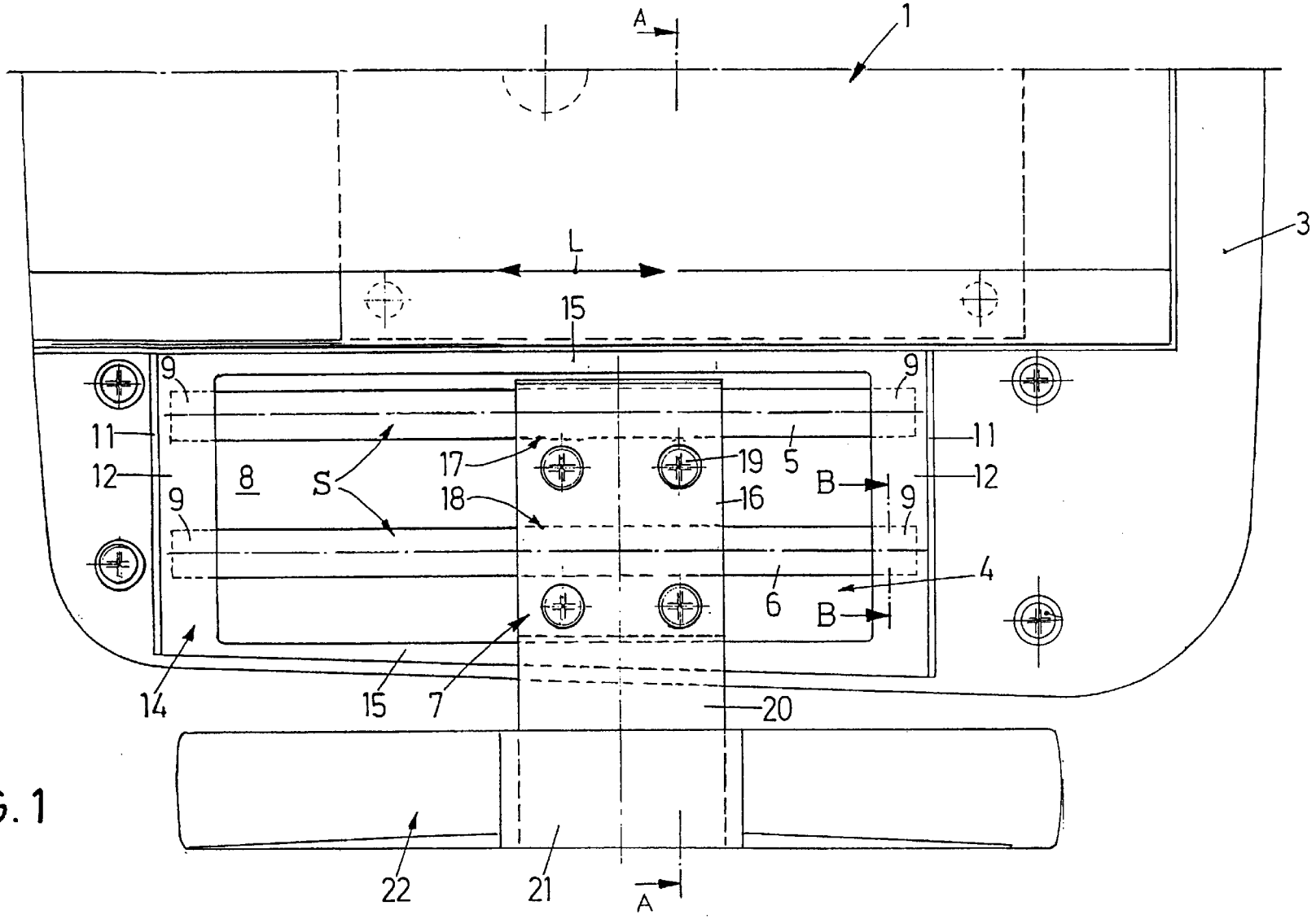
FIG. 1 is a partial view of a universal seat carrier panel with armrest module fastened thereon, from below.
Figure 2:
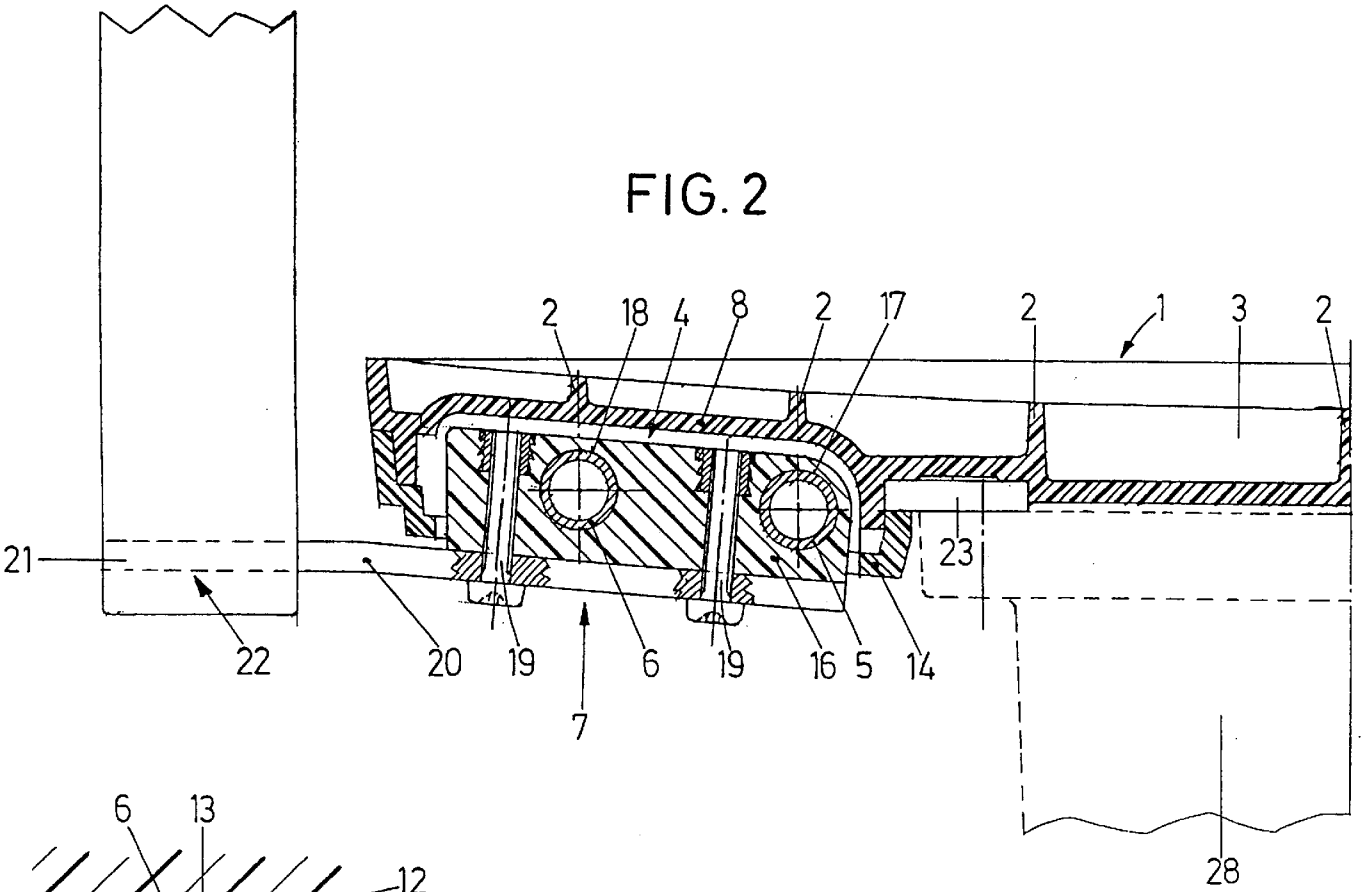
FIG. 2 is a vertical section along section line A—A in FIG. 1.
Figure 3:
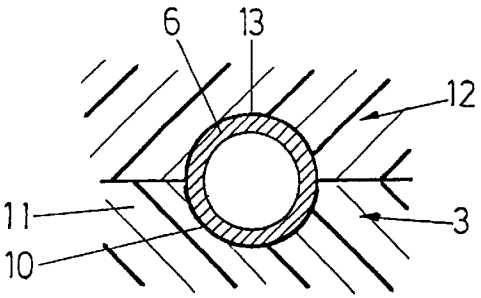
FIG. 3 is a vertical section through a detail along section line B—B in FIG. 1.

The seat carrier panel 1 shown in FIGS. 1 to 3 has a substantially plane panel member 3 of injection-molded plastics material which is provided with reinforcing ribs 2 (FIG. 2) and of which the contour and plan view correspond substantially to the seat surface of an office chair. In the two border regions of this panel member 3, on the longitudinal sides, there are provided respective rectangular recesses 4 which are open at the bottom and in which are arranged two guide tubes 5, 6 which extend next to one another horizontally and in parallel in the longitudinal direction L of the chair and form a slideway S integrated in the panel member 3 for an armrest holder 7. The two guide tubes 5, 6 are so arranged that they are at a radial distance from the wall 8 of the panel member 3 forming the recess 4.

The two guide tubes 5, 6 are each inserted with their two ends 9 into a semi-cylindrical bearing bush 10 in the transversely extending end walls 11 of the recess 4 and fixed by a locking member 12 which can be latched on the panel member 3 with a counter bearing bush 13 which is also semicylindrical (FIG. 3). The two locking members 12 are part of a common locking frame 14 (FIG. 1), which is formed in one piece from injection molded plastics material by the two locking members 12 and the longitudinal struts 15 connecting them.

On the two guide tubes 5, 6 rests a substantially cuboid block 16 of the armrest holder 7 whose two cylindrical bearing bores 17, 18 extend through the block 16 in the longitudinal direction L of the chair and are penetrated by the guide tubes 5, 6. The internal diameters of the bearing bores 17, 18 are adapted to the external diameters of the guide tube 5, 6 in such a way that these components form a slidable snug-fit mounting. This means that the block 16 rests firmly on the guide tubes 5, 6 without wobbling and does not move under normal stress when the armrests are in use.

A holding strut 20 which is designed as a flat iron element and extends outwardly transversely to the longitudinal direction L of the chair is screwed onto the block 16 from below by screws 19. The actual armrest member 22 which can consist, for example, of a substantially triangular injection molded plastics part resting on the head, is fastened with the end 21 of the holding strut 20 projecting beyond the panel member 3. The obliquely upwardly extending limbs of this member form the armrest column while the upper, horizontally extending limb forms the arm support of the armrest member 22.

For longitudinal adjustment of the armrest, the block 16 merely has to be vigorously displaced along its slideway S. In an advantageous manner, therefore, no unlocking or the like is required. For an office chair without armrests, the armrest member 22 with its armrest holder 7 and the guide tubes 5, 6 can simply be omitted, while the universal seat carrier panel 1 is otherwise still used without further modifications.

FIGS. 1 and 2 also show, on the underside U of the panel member 3 opposite the recesses 4, two slide rails 23 which are offset inwardly and by means of which the seat carrier panel 1 is supported in a sliding manner on a seat carrier 28 indicated in broken lines in FIG. 2. The metallic slide rails 23 form a wear-resistant slideway for the seat depth adjustment of the upholstered seat surface panel not shown in FIGS. 1 and 2 parallel to the longitudinal direction L of the chair.

Figure 4:
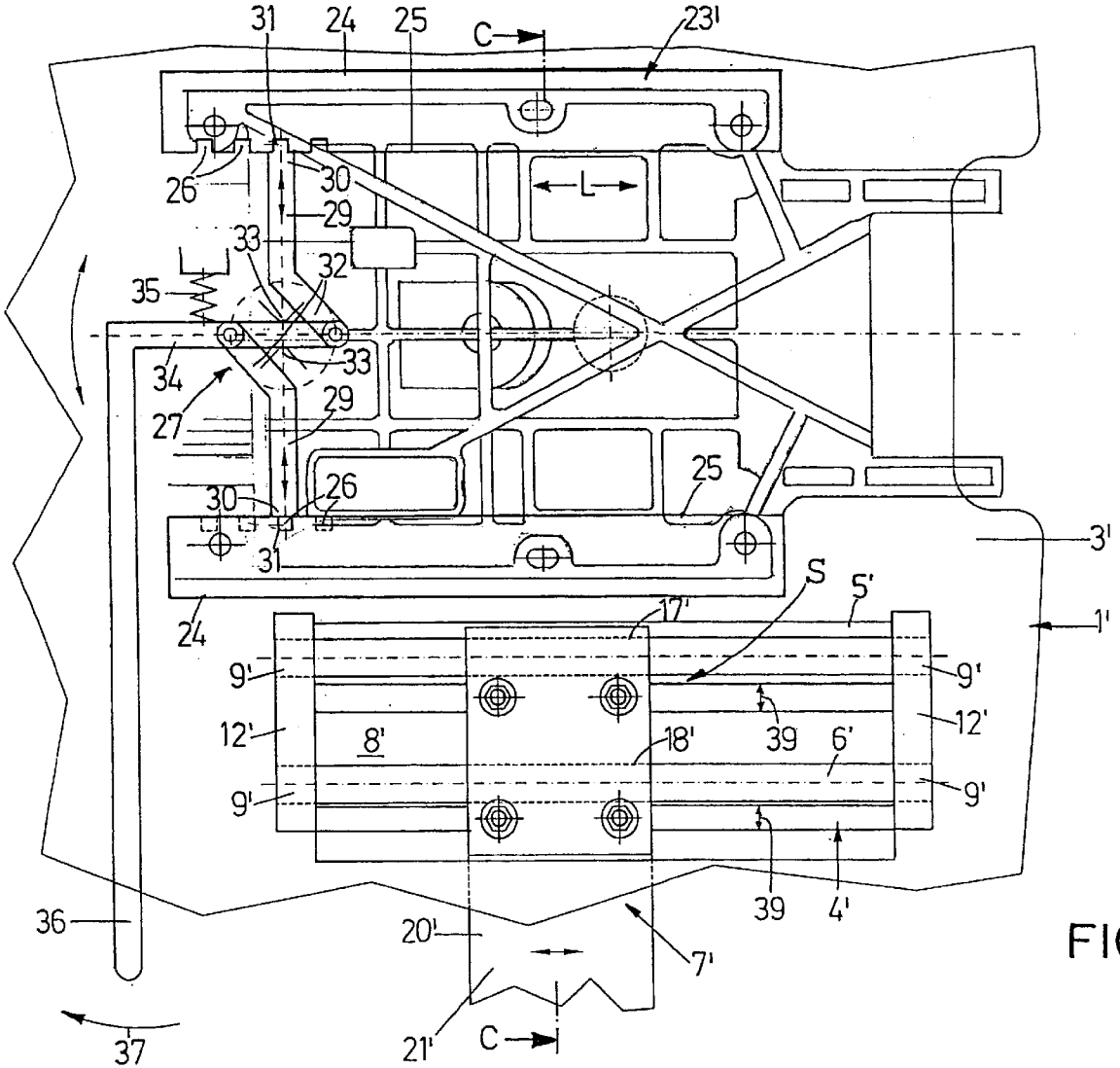
FIG. 4 is a schematic view of a second embodiment of a universal seat carrier panel.
Figure 5:
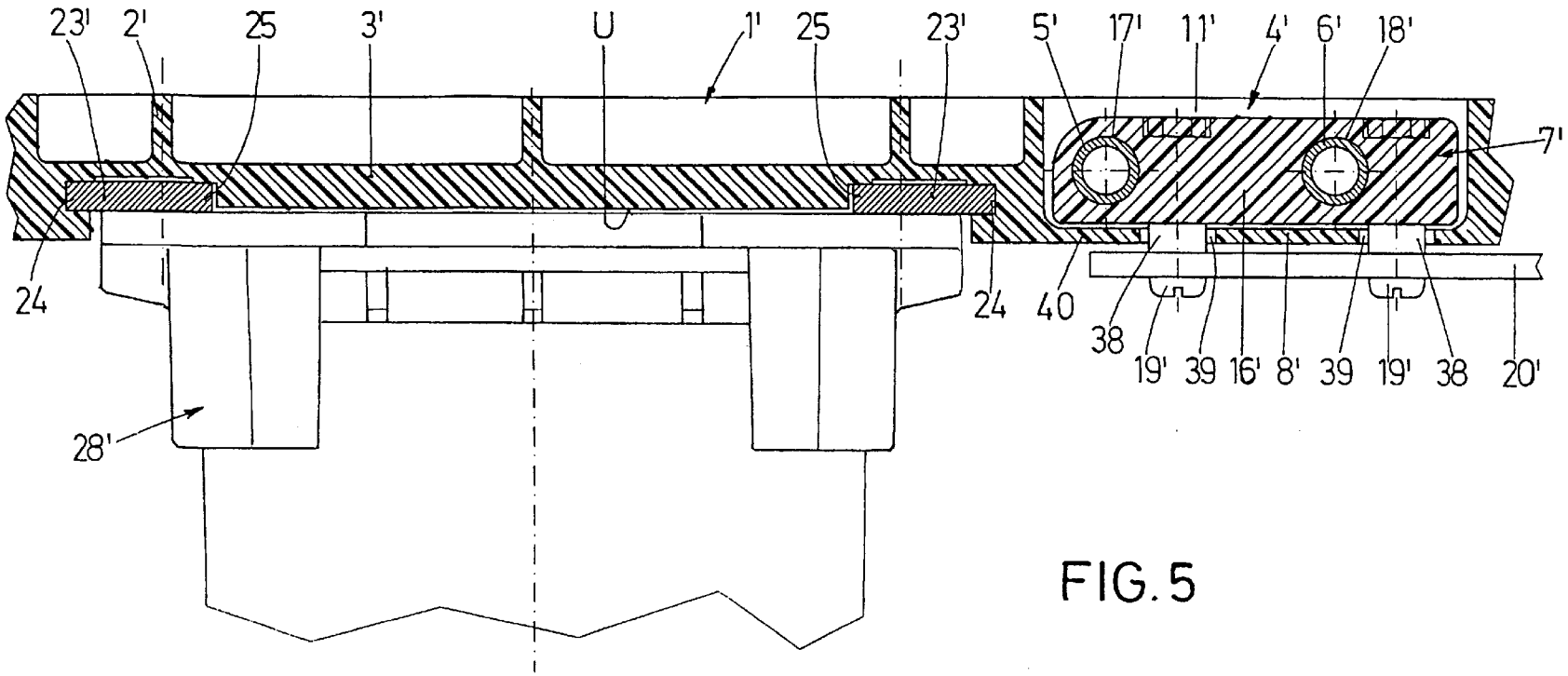
FIG. 5 is a vertical section along section line C—C in FIG. 4.

In the embodiments illustrated schematically in FIGS. 4 and 5, latched seat depth adjustment by means of this slide rail 23' is shown. The slide rails 23' with their outwardly directed border edges 24 are inserted into a corresponding recess in the panel member 3' and thereby fixed on the panel member 3'. On the mutually facing internal edges 25 of the slide rails 23', at the front end, there is provided a number of latching orifices 26 which cooperates with a manually actuable latching mechanism 27 on the seat carrier 28 indicated in fine lines. This latching mechanism 27 consists of two latching levers 29 which can be moved to and fro transversely to the longitudinal direction L of the chair and can engage with their latching projections 31 located at the outer ends 30 in one of the latching orifices 26 in each case. The inner ends 32 which are angled in opposite directions are articulated on a driving lever 34 which is pivotal about a pivot bearing 33 and is spring-loaded in an anti-clockwise direction with respect to FIG. 4 by a helical compression spring 35 supported on the seat carrier 28 so the driving lever 34 pushes the latching lever 29 in the engagement direction thereof with respect to the latching orifices 26. To release the latching mechanism 27, the driving lever 34 has, at its free end, an actuating handle 36 which projects at right angles to the side, rotates the driving lever 34 in a clockwise direction with respect to FIG. 4 by pivoting forwards 37 and therefore draws the two latching levers 29 inwardly. The latching projections 31 pass from the latching orifices 26 of the slide rail 23' and the universal seat carrier panel 1 can be displaced in the longitudinal direction L of the chair relative to the seat carrier 28. The driving lever 34 is pivoted back again by releasing the actuating handle 36 and the latching levers 29 engage in the corresponding latching orifice 26 again.

The seat carrier panel 1' according to FIGS. 4 and 5 also has an armrest holder 7' which differs only in a few details from the embodiment illustrated in FIGS. 1 to 3. Corresponding components in FIGS. 4 and 5 are therefore provided with apostrophized reference numerals and do not require fiber explanation. The differences from the embodiment in FIGS. 1 and 2 will simply be described as follows:

The recess 4' is open at the top and the two guide tubes 5, 6 are fixed by individual locking members 12'. A locking frame 14 is not provided in this embodiment.

The holding strut 20 is also screwed from below via spacer sleeves 38 to the block 16, the spacer sleeves 38 being arranged in longitudinally extending slots 39 in the base wall 40 of the recess 4'. If the armrest module is omitted, only the slots 39 can be seen from below on the seat carrier panel 1', so the seat carrier panel 1' has a very plane appearance.

What is claimed is:

1. A universal seat carrier panel for office chairs comprising a panel member (3, 3') for arrangement on one of a chair column and a seat carrier (28), an armrest member (22) supported by an armrest holder (7, 7') on said panel member (3: 3'), and a slideway (S, S') integrated in the panel member (3, 3') for adjustability of the armrest holder (7, 7') in a horizontal longitudinal direction (L) with respect to the panel member (3, 3');

wherein the slideway comprises two guide elements (5, 6; 5', 6') which extend horizontally next to one another in parallel in a longitudinal direction of the panel member (3, 3') and on which rests a block (16, 16') carrying the armrest holder (7, 7');

wherein the guide elements (5, 6; 5', 6') are arranged in a recess (4, 4') in the seat carrier panel (1, 1') which is open at a bottom of said seat carrier panel (1, 1'); and wherein the guide elements (5, 6; 5', 6') are mounted with their ends (9, 9') each in a semicylindrical bearing bush (10) and are fixed by a locking member (12, 12') which can be placed and locked on the panel member (3, 3'), with a counter-bearing bush (13) which is also semicylindrical.

2. The universal seat carrier panel according to claim 1, wherein the locking members (12) are integrated in a common locking frame (14).

3. A universal seat carrier panel for office chairs comprising a panel member (3, 3') for arrangement on one of a chair column and a seat carrier (28), an armrest member (22) supported by an armrest holder (7, 7') on said panel member (3, 3'), and a slideway (S, S') integrated in the panel member (3, 3') for adjustability of the armrest holder (7, 7') in a horizontal longitudinal direction (L) with respect to the panel member (3, 3');

wherein the slideway comprises two guide elements (5, 6: 5', 6') which extend horizontally next to one another in parallel in a longitudinal direction of the panel member (3, 3') and on which rests a block (16, 16') carrying the armrest holder (7, 7');

wherein the block (16, 16') is provided with two preferably cylindrical bearing bores (17, 18; 17', 18') which are penetrated by the guide elements (5, 6; 5', 6') and form a slidable snug-fit mounting with the guide elements (5, 6; 5', 6').

4. The universal seat carrier panel according to claim 3, wherein the guide elements (5, 6; 5', 6') are arranged in a recess (4, 4') in the seat carrier panel (1, 1') which is open at a bottom of said seat carrier panel (1, 1').

5. The universal seat carrier panel according to claim 3, wherein the guide elements are designed as guide tubes (5, 6; 5', 6').

6. The universal seat carrier panel for office chairs comprising a panel member (3, 3') for arrangement on one of a chair column and a seat carrier (28), an armrest member (22) supported by an armrest holder (7, 7') on said panel member (3, 3'), and a slideway (S, S') integrated in the panel member (3, 3') for adjustability of the armrest holder (7, 7') in a horizontal longitudinal direction (L) with respect to the panel member (3, 3');

wherein, in the panel member (3, 3') on its underside (U), there are integrated two slide rails (23, 23') which extend next to one another horizontally and in parallel in the longitudinal direction (L) of the panel member (3, 3'), and on which the seat carrier panel (1, 1') can be displaced in the longitudinal direction of the panel member (3, 3'), for adjustment of a seat depth on the chair column or the seat carrier (28);

wherein the slide rails (23') are each provided with a number of latching orifices (26) which cooperate with a manually actuable latching mechanism (27).

7. The universal seat carrier panel according to claim 6, wherein the slide rails (23') comprise mutually facing internal edges (25), on which the latching orifices (26) are arranged.

8. The universal seat carrier panel according to claim 6, wherein the slide rails (23') comprise border edges (24), which are inserted into the panel member (3').

* * * * *